US008636548B2

(12) United States Patent
Fu et al.

(10) Patent No.: US 8,636,548 B2
(45) Date of Patent: Jan. 28, 2014

(54) CARD EDGE CONNECTOR WITH IMPROVED CENTRAL SLOT

(75) Inventors: Xiao-Zhi Fu, Kunshan (CN); Ze-Lin Yao, Kunshan (CN); Zhuang-Xing Li, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 174 days.

(21) Appl. No.: 13/249,255

(22) Filed: Sep. 30, 2011

(65) Prior Publication Data

US 2012/0088375 A1 Apr. 12, 2012

(30) Foreign Application Priority Data

Oct. 8, 2010 (CN) ..... 2010 2 0551023

(51) Int. Cl.
*H01R 24/00* (2011.01)

(52) U.S. Cl.
USPC ..... 439/637

(58) Field of Classification Search
USPC ..... 439/63, 636, 630
See application file for complete search history.

(56) References Cited

U.S. PATENT DOCUMENTS

| | | | | |
|---|---|---|---|---|
| 4,026,014 | A * | 5/1977 | Sugimoto et al. | 29/884 |
| 4,795,374 | A | 1/1989 | Rishworth et al. | |
| 6,152,742 | A * | 11/2000 | Cohen et al. | 439/60 |
| 6,814,583 | B1 * | 11/2004 | Young et al. | 439/65 |

* cited by examiner

*Primary Examiner* — Xuong Chung Trans
(74) *Attorney, Agent, or Firm* — Wei Te Chung; Ming Chieh Chang

(57) ABSTRACT

A card edge connector includes an elongated housing extending along an elongated direction thereof, and having a first housing half, a second housing half being discrete from the first housing half, and a central slot formed between the first and the second housing halves. A plurality of contacts are retained in the housing, and each has a contact portion protruding into the central slot. A width of the central slot could be adjusted before mounting the card edge connector to a mother board for receiving different daughter boards with different thicknesses.

19 Claims, 4 Drawing Sheets

CARD EDGE CONNECTOR WITH IMPROVED CENTRAL SLOT

BACKGROUND OF THE INVENTION

1. Field of the Invention

The present invention relates to a card edge connector, more particularly to a card edge connector with an improved central slot adapted for receiving at least two daughter boards having different widths.

2. Description of Related Art

Card edge connectors are employed widely in computers to be soldered on a mother board for receiving a daughter board. The card edge connector usually has an elongated housing, and a plurality of contacts retained in the housing for electrically connecting the daughter board and the mother board. The housing has a pair of side walls and a central slot formed therebetween for insertion of the daughter board. The contacts are retained in the side walls respectively, and have contact portions protruding into the central slot for mechanically and electrically connecting with the daughter board. However, in the card edge connector, the central slot is usually established to be only one width for receiving the daughter board with a certain width. And this type of card edge connector can not be adapted for another daughter board with another different width, people need another type of card edge connector. It would increase the manufacturing cost.

Hence, an improved card edge connector is desired to overcome the above problems.

BRIEF SUMMARY OF THE INVENTION

According to one aspect of the present invention, a card edge connector, comprises: A card edge connector comprising: an elongated housing extending along an elongated direction thereof and having a first housing half, a second housing half being discrete from the first housing half, and a central slot formed between the first and the second housing halves; and a plurality of contacts retained in the housing, each contact having a contact portion protruding into the central slot; wherein the first housing half having a first engaging surface, the second housing half having a second engaging surface facing to the first engaging surface in a transverse direction perpendicular to the elongated direction, a gap being defined between the first and the second surfaces and being adjustable to define the central slot with different widths for receiving different daughter boards with different thicknesses.

According to another aspect of the present invention, a card edge connector assembly, comprises: a first housing half extending along an elongated direction thereof; a second housing half opposited to the first housing half in a transverse direction perpendicular to the elongated direction to define a central slot therebetween, the central slot defining a width in the transverse direction; a plurality contacts divided into two rows aligned along the elongated direction and retained the first and the second housing halves, respectively, the contacts having soldering tails disposed in a level planar; and a printed circuit board (PCB) to which the first and the second housing halves are mounted, and the PCB having a plurality of circuit traces engaging with the soldering tails of the contacts; wherein the width of the central slot being regulatable for insertion of different daughter boards with different thicknesses before the soldering tails of the contacts are soldered with the circuit traces of the PCB.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
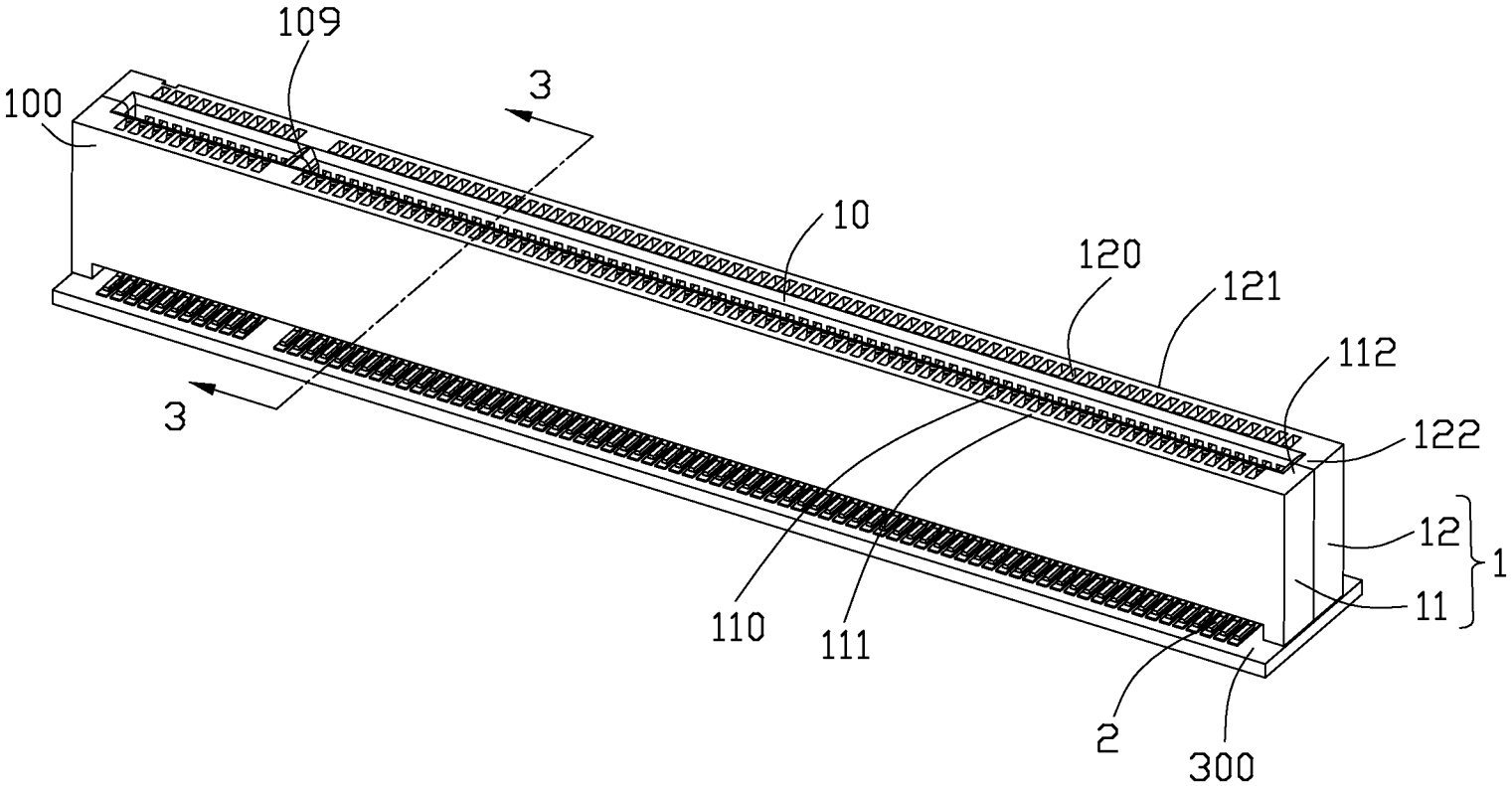
FIG. 1 is an assembled perspective view of a card edge connector mounted on a mother board and according to the present invention.
Figure 2:
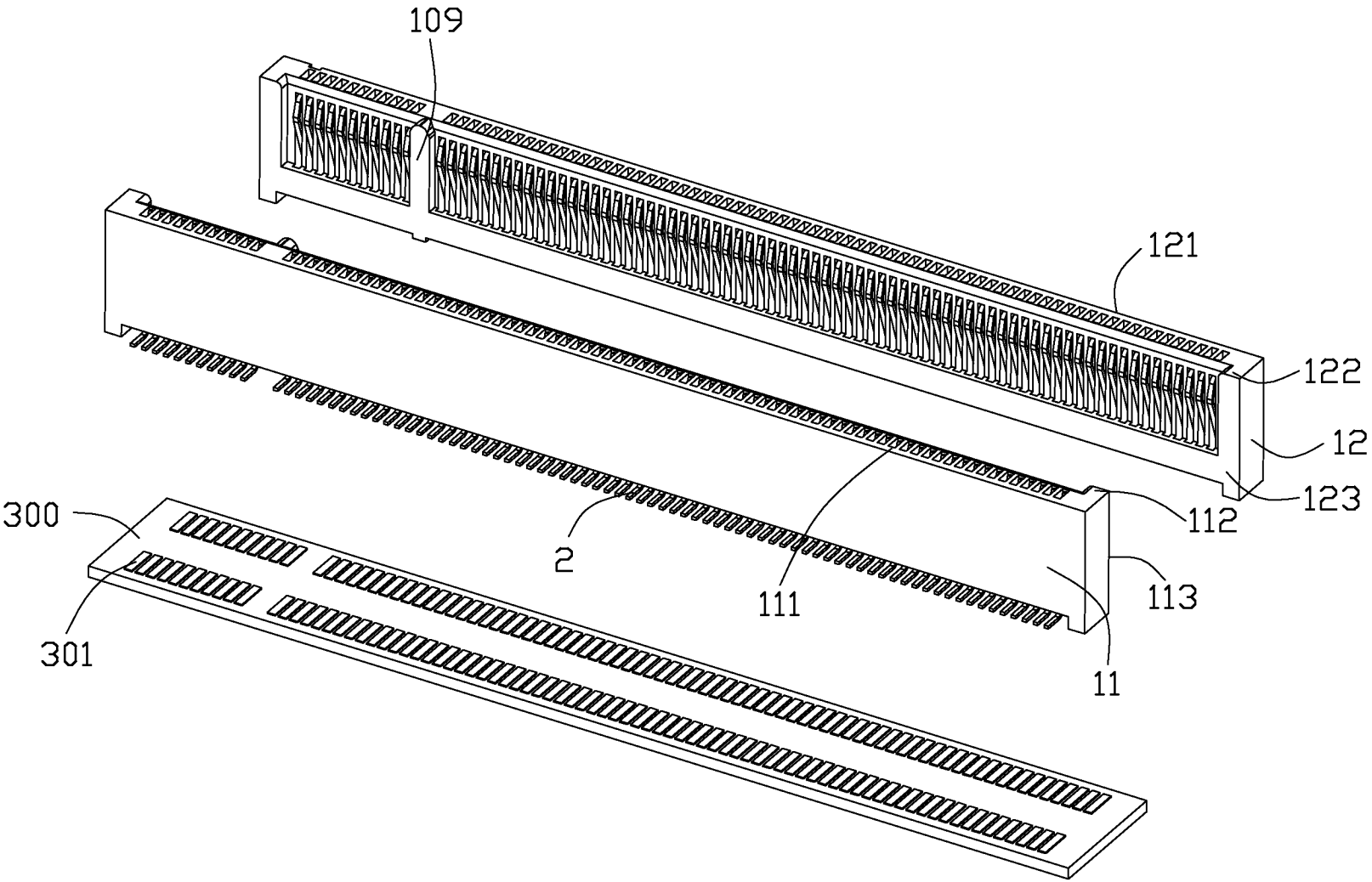
FIG. 2 is an exploded perspective view of the card edge connector shown in FIG. 1.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Referring to FIGS. 1-4, a card edge connector 100 according to the present invention adapted for mating with different daughter boards (not shown) with different thickness is disclosed. The card edge connector 100 is a PCI-E connector mounted onto a mother board 300, and comprises an elongated housing 1, and a plurality of contacts 2 retained in the housing 1. The mother board 300 has two rows of circuit traces 301 for engaging with the contacts 2.

Figure 3:
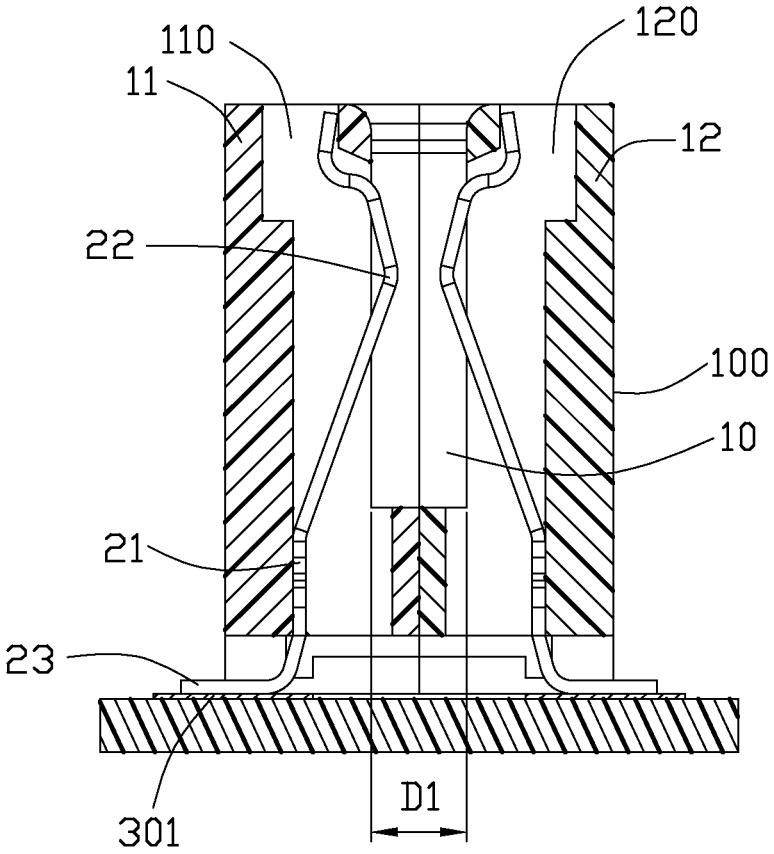
FIG. 3 is a cross-sectional view of the card edge connector mounted on the mother board shown in FIG. 1, wherein the card edge connector is adapted for receiving a thin daughter board.
Figure 4:
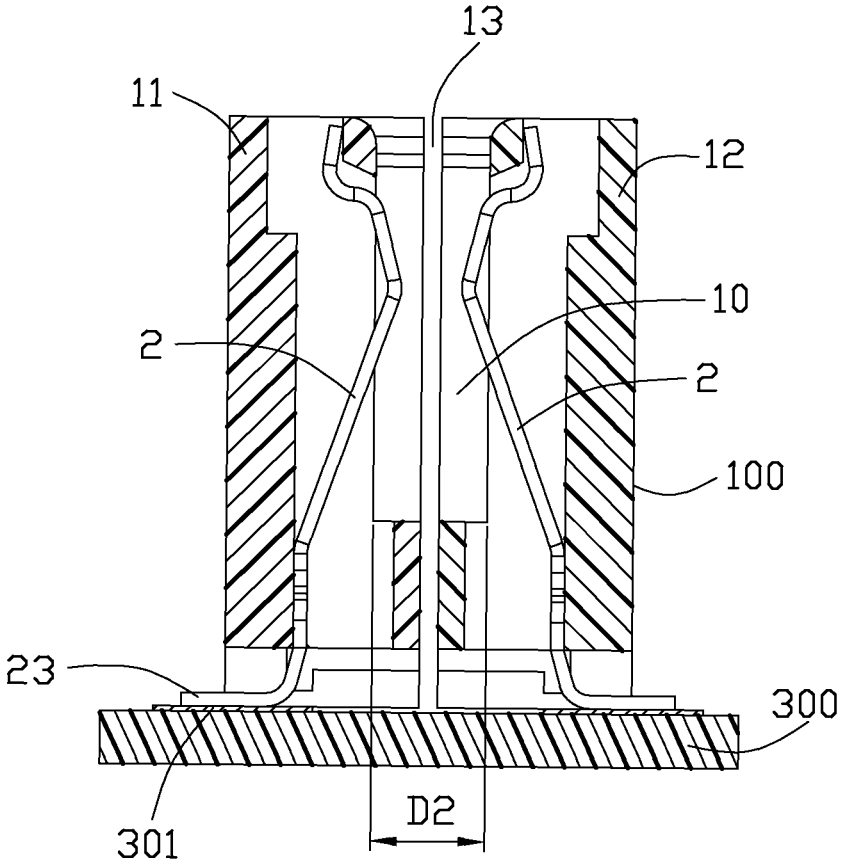
FIG. 4 is another cross-sectional view of the card edge connector mounted on the mother board shown in FIG. 1, wherein the card edge connector is adapted for receiving a thick daughter board.

The housing 1 includes a first housing half 11 and a second housing half 12 being discrete from the first housing half 11 along a transverse direction perpendicular to the elongated direction. The first and the second housing halves 11, 12 are cooperated with each other to form a central slot 10 therebetween. Before the card edge connector 100 is mounted on the mother board 300, a distance between the first and the second housing halves 11, 22 in the transverse direction is easily adjusted to define the width of central slot 10. A gap 13 defined between the first and the second housing halves 11, 12 has a width being greater than or equal to zero. Thus, card edge connector 100 would be used to receive different daughter boards with different thickness. Referring to FIG. 3, the first housing half 11 and the second housing half 12 are jointed together and abut against each other, thus a central slot 10 is defined with a small width D1 for mating a daughter board with a small thickness. Referring to FIG. 4, the first housing half 11 and the second housing half 12 are spaced away from each other to keep the gap 13 therebetween, thus another central slot 10 is defined with a big width D2 (D2>D1) for mating another daughter board with a big thickness.

The first housing half 11 and the second housing half 12 are symmetrical with each other along an elongated line of the card edge connector 100. The first housing half 11 and the second housing half 12 each has a side wall 111/121, and two opposite end walls 112/122 protruding inwardly from two ends of the side wall 111/121. The ends walls 112 of the first housing half 11 has a first vertical engaging surface 113 facing to and engaging with a second vertical surface 123 disposed on the end walls 122 of the second housing half 12 in the transverse direction. A gap 13 is defined between the first and the second engaging surfaces 113, 123. The gap 13 is not present while the first and the second engaging surfaces 113, 123 abut against with each other. Of course, the first and the second engaging surface 113, 123 could be formed on bottoms of the first and the second housing halves 11, 12. The central slot 10 is formed among the side walls 111, 121 and the end walls 112, 122. Thus, the central slot 10 is partially formed on the first housing half 11 and the second housing half 12, respectively. The first housing half 11 and the second housing half 12 have a key portion 109 to divide the central slot 10 into two parts with different lengths for preventing the daughter board from mis-mating. The first housing half 11 and the second housing half 12 each defines a row of passageways 110, 120 along the elongated direction and communicating with the central slot 10.

The contacts 2 are divided into two rows contacts retained in the first housing half 11 and the second housing half 12, respectively. The contacts 2 each has a securing portion 21 retained in the passageway 110/120, an elastic contact portion 22 protruding into the central slot 10 to electrically connect with the daughter boards, and a soldering tail 23 extending out of the housing 1 from the securing portion 21. The soldering tails 23 of the contacts 2 are aligned in a level planar generally parallel to the mother board 300 for surface mounting to the circuit traces 301. The soldering tails 23 are connected to the circuit traces 301 most commonly by soldering.

The first housing half 11 and the second housing half 12 with contacts 2 are mounted on the mother board 300 by soldering, respectively. The soldering tails 23 are soldered with circuit traces 301 after a dimension of the gap 13 between the first housing half 11 and the second housing half 12 is decided according to the thickness of the daughter board which is to be received by the card edge connector 100. Thus, the card edge connector 100 are adapted for mating different daughter boards with different thickness, just by adjusting the gap 13 before the card edge connector 100 is mounted on the mother board 300, sometime, the gap 13 may not present. In most commonly use, the first housing half 11 and the second housing half 12 could have an auxiliary means (not shown) for ensuring the card edge connector 100 can be mounted on the mother board 300 reliably and preventing the housing halves 11, 22 from moving relative to each other before soldering. The auxiliary means also could be disposed on the mother board 300. The auxiliary means could be positioning posts, interlocking device, or retaining bracket, etc.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector comprising:

an elongated housing extending along an elongated direction thereof and having a first housing half, a second housing half being discrete from the first housing half, and a central slot formed between the first and the second housing halves; and two rows of contacts retained in the first and second housing halves respectively, each contact of the two rows of the contacts having a contact portion protruding into the central slot, a securing portion being vertically retained in the first/second housing half, and a soldering tail connecting the securing portion;

wherein the first housing half having a first engaging surface, the second housing half having a second engaging surface facing to the first engaging surface in a transverse direction perpendicular to the elongated direction, a gap being defined between the first and the second surfaces and being adjustable to define the central slot with different widths respectively for receiving different daughter boards with different thicknesses, each of the first and second housing halves has a depression depressed at the lower side thereof and a pair of standoffs formed at two opposite ends of the depression in the elongated direction, the soldering tails of each row of the contacts extend horizontally out from the corresponding depression under condition that lower surfaces of the soldering tails and lower surfaces of the standoffs are located in a same horizontal plane.

2. The card edge connector as claimed in claim 1, wherein the central slot is defined with a small width for mating a daughter board with a small thickness in condition that the gap is not present while the first and the second engaging surfaces abut against with each other, the central slot is defined with a big width for mating a daughter board with a big thickness in condition that the gap is present while the first and the second engaging surfaces are spaced away from each other.

3. The card edge connector as claimed in claim 1, wherein the contacts are divided into two rows aligned along the elongated direction and retained in the first and the second housing halves, respectively.

4. The card edge connector as claimed in claim 1, further comprising an auxiliary means located on the housing for retaining the first and the second housing halves on the mother board, respectively.

5. The card edge connector as claimed in claim 1, further comprising an auxiliary means located on the housing to assemble the first and the second housing halves together.

6. The card edge connector as claimed in claim 1, wherein the first housing half and the second housing half are symmetrical with each other along an elongated line of the card edge connector, the central slot is partially formed on the first and the second housing halves.

7. The card edge connector as claimed in claim 1, wherein the first and the second housing halves each has a side wall, and two opposite end walls extending inwardly from two ends of the side wall, the side walls each defines a plurality of passageways retaining the contacts therein, the central slot is formed among the side walls and the end walls.

8. The card edge connector as claimed in claim 1, wherein each of the first and second housing halves has a key portion located in the central slot and facing to the other in the transverse direction;

and a protrusion aligned to the key portion in a height direction and protruding downwardly into the depression, the protrusions have lower surfaces located at a plane higher than the same horizontal plane.

9. The card edge connector as claimed in claim 8, wherein the protrusions have recesses recessed upwardly from the lower surfaces thereof and facing to each other.

10. A card edge connector assembly comprising:

a first housing half extending along an elongated direction thereof;

a second housing half opposited to the first housing half in a transverse direction perpendicular to the elongated direction to define a central slot therebetween, the central slot defining a width in the transverse direction;

a plurality contacts divided into two rows aligned along the elongated direction and retained the first and the second housing halves, respectively, the contacts having soldering tails disposed in a level plane; and a printed circuit board (PCB) to which the first and the second housing halves are mounted, and the PCB having a plurality of circuit traces engaging with the soldering tails of the contacts;

wherein the width of the central slot being regulatable for insertion of different daughter boards with different thicknesses before the soldering tails of the contacts are soldered with the circuit traces of the PCB, each of the first and second housing halves has a depression depressed at a lower side thereof and a pair of standoffs formed at two opposite ends of the depression in the elongated direction, the soldering tails of each row of the contacts extend horizontally out from the corresponding depression under condition that lower surfaces of the standoffs are coplanar with the level plane which the soldering tails are disposed in.

11. The card edge connector assembly as claimed in claim 10, wherein the first housing half is spaced away from the second housing half along the transverse direction to form a gap therebetween along the transverse direction.

12. The card edge connector assembly as claimed in claim 11, further comprising an auxiliary means to make sure the first and the second housing halves to be assembled with the PCB together, the auxiliary means is disposed on at least one of the first housing half, the second housing half, and the mother board.

13. The card edge connector assembly as claimed in claim 11, wherein the first housing half and the second housing half are symmetrical with each other along an elongated line of the card edge connector, the central slot is partially formed on the first and the second housing halves, the first and the second housing halves each has a side wall, and two opposite end walls extending inwardly from two ends of the side wall, the side walls each defines a plurality of passageways retaining the contacts therein, the central slot is formed among the side walls and the end walls.

14. The card edge connector as claimed in claim 10, wherein each of the first and second housing halves has a key portion located in the central slot and facing to the other in the transverse direction;

and a protrusion aligned to the key portion in a height direction and protruding downwardly into the depression, the standoffs resist against the PCB while the protrusions do not.

15. A card edge connector for mounting to a printed circuit board and receiving a daughter card therein, comprising:

an elongated insulative housing extending along a lengthwise direction and including a pair of housing halves essentially being of mirror images and in confrontation with each other in a transverse direction perpendicular to said lengthwise direction;

each of said housing halves defining one sided elongated slot along the lengthwise direction so as to cooperate with that of the other to commonly form a center slot of said housing for receiving the corresponding daughter card, each of said housing halves further being equipped with a half key in the corresponding one sided elongated slot to confront that of the other in the transverse direction, said half key extending upwardly with a full height of the corresponding sided elongated slot; and one row of terminals beside said one sided slot in the transverse direction so as to cooperate with those of the other to provide two rows of terminals located respectively by two sides of the center slot in the transverse direction; wherein a gap between the pair of housing halves in the transverse direction is variable to have the center slot variable correspondingly for compliance with different daughter cards having different thicknesses thereof; wherein when the housing halves are arranged to intimately confront each other without the gap therebetween, the half key of one housing half abuts against that of the other housing half with a full height of said center slot.

16. The card edge connector as claimed in claim 15, wherein tails of the terminals are in form of surface mount.

17. The card edge connector as claimed in claim 16, wherein each terminal defines a resilient contacting section extending into the center slot in said transverse direction.

18. The card edge connector as claimed in claim 15, wherein said pair of housing halves are completely discrete from each other without unitary connection therebetween in the transverse direction.

19. The card edge connector as claimed in claim 15, wherein each of said housing halves a protrusion aligned to the respective half keys in a height direction and protruding downwardly into the depression, the protrusions have lower surfaces located at a plane higher than the same horizontal plane to present the housing halves from over deformation at the position of the half keys.

* * * * *